US008167737B2

(12) United States Patent
Oyama

(10) Patent No.: US 8,167,737 B2
(45) Date of Patent: May 1, 2012

(54) WOOD-TYPE GOLF CLUB HEAD

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 216 days.

(21) Appl. No.: 12/352,643

(22) Filed: Jan. 13, 2009

(65) Prior Publication Data

US 2009/0258727 A1 Oct. 15, 2009

(30) Foreign Application Priority Data

Apr. 15, 2008 (JP) ..... 2008-105946

(51) Int. Cl.
*A63B 53/04* (2006.01)

(52) U.S. Cl. ..... 473/330; 473/345; 473/349

(58) Field of Classification Search ..... 473/324–350, 473/287–292
See application file for complete search history.

(56) References Cited

U.S. PATENT DOCUMENTS

| | | | | |
|---|---|---|---|---|
| 3,625,518 | A * | 12/1971 | Solheim | 473/330 |
| 5,681,228 | A * | 10/1997 | Mikame et al. | 473/330 |
| 6,344,002 | B1 * | 2/2002 | Kajita | 473/330 |
| 6,402,639 | B1 * | 6/2002 | Iwata et al. | 473/330 |
| 6,428,426 | B1 * | 8/2002 | Helmstetter et al. | 473/330 |
| 6,454,664 | B1 * | 9/2002 | Long et al. | 473/330 |
| 6,458,043 | B1 * | 10/2002 | McCabe et al. | 473/330 |
| 6,508,722 | B1 * | 1/2003 | McCabe et al. | 473/330 |
| 6,582,322 | B2 * | 6/2003 | Long et al. | 473/330 |
| 6,964,617 | B2 * | 11/2005 | Williams | 473/245 |
| 7,059,972 | B2 * | 6/2006 | Miyamoto | 473/330 |
| 7,066,830 | B2 * | 6/2006 | Day | 473/324 |
| 7,147,572 | B2 * | 12/2006 | Kohno | 473/314 |
| 7,163,468 | B2 * | 1/2007 | Gibbs et al. | 473/329 |
| 2009/0191980 | A1 * | 7/2009 | Greaney et al. | 473/345 |

FOREIGN PATENT DOCUMENTS

| | | | |
|---|---|---|---|
| JP | 8-89603 | A | 4/1996 |
| JP | 2001-161866 | A | 6/2001 |

* cited by examiner

*Primary Examiner* — Sebastiano Passaniti
(74) *Attorney, Agent, or Firm* — Birch, Stewart, Kolasch & Birch, LLP

(57) ABSTRACT

A hollow wood-type golf club head with stable flight direction and flight distance performances, the club head having a moment of inertia Ix 4,000 to 5,900 g·cm$^2$ about a vertical axis passing through the club head's center of gravity, and comprising a face with face bulge and face roll such that the radius of curvature Rx of the face bulge is from 12 to 25 inches, and the Ry/Rx ratio of the radius of curvature Ry of the face roll to the radius of curvature Rx of the face bulge is 0.50 to 0.90.

4 Claims, 8 Drawing Sheets

WOOD-TYPE GOLF CLUB HEAD

BACKGROUND OF THE INVENTION

The present invention relates to a wood-type golf club head having stable performances of flight direction and flight distance of hit ball.

As shown in FIG. 8A as to a wood-type golf club head "a" for right-handed golfers (all explanations made herein being for right-handed golfers), if a golf ball "b" is struck by the wood-type golf club head "a" at a position on a toe side of a sweet spot SS that is a point at which a normal line drawn from the center of gravity G of the club head with respect to a face "f" intersects the face "f" (such a hitting may be hereinafter referred to as "toe hit"), the club head rotates clockwise about the center of gravity G. In the ball which is in contact with the face, a side spin which causes the ball to rotate in the counterclockwise direction opposite to the rotation of the club head (i.e., so-called hook spin for right-handed golfers) generates. On the other hand, if the club head hits the ball on a heel side of the sweet spot SS (such a hitting may be hereinafter referred to as "heel hit"), the club head rotates counterclockwise about the center of gravity G, and the ball which is in contact with the face causes a side spin of the clockwise rotation (so-called slice spin). Such a phenomenon is well known as a gear effect. If the face "f" is flat, as shown in FIG. 8A, the ball "b" is struck out approximately parallel to the target flight direction "j" and thereafter the ball is driven to the left or right direction to cause a hook or slice.

In order to solve such a problem of poor flight direction performance, a face bulge has been conventionally provided to the face "f" of the wood-type golf club head "a", as shown in FIG. 8B. The face bulge is a rounded or curved surface having a radius of curvature Rx which is smoothly and slightly convex toward the front side. In case of a toe hit by a club head provided with a face bulge, the ball is struck out at a deflection angle θ with respect to the target flight direction "j" by the face bulge, and then would hook by a side spin to curve back toward the target flight direction. In case of a heel hit, the ball is struck out at a deflection angle to the left of the target flight direction "j", and then would slice by a side spin to curve back toward the target flight direction. Therefore, the face bulge serves to improve the flight direction performance by a side spin caused by a horizontal gear effect.

A similar phenomenon to the horizontal gear effect also takes place about a horizontal axis passing through the head's center of gravity G in the toe-heel direction. This may also be called "vertical gear effect". For example, as shown in FIG. 9A, if the club head "a" hits the golf ball "b" on a crown "c" side above the sweet spot SS of the face "f" (such a hitting may be hereinafter referred to as "high hit") or on a sole "s" side below the sweet spot SS (such a hitting may be hereinafter referred to as "low hit"), the club head rotates about the horizontal toe-heel axis by a moment which is the product of a force F received from the golf ball "b" and a vertical distance L1 or L2 between a hitting position and the center of gravity G. At that time, the golf ball contacting the face "f" receives a force acting in the direction opposite to the rotation of the club head "a" by a frictional force. Thus, off-center hits above the sweet spot reduce the amount of backspin of the golf ball "b", and off-center hits below the sweet spot increase the amount of the backspin.

In order to prevent such an uneven backspin amount from occurring, a face roll has been conventionally provided to the face "f" of the wood-type golf club head "a", as shown in FIG. 9A. The face roll is a rounded or curved surface having a radius of curvature Ry which is smoothly and slightly convex toward the front side when the face is viewed from the side.

In case of hitting a golf ball "b" by club heads "a" shown in FIGS. 9A and 9B at the same position below or above the sweet spot SS, the vertical distance L1 or L2 between the force F and the center of gravity G is larger when hitting by a face "fn" having no face roll of the club head shown in FIG. 9B as compared with the hitting by a face "f" having a face roll of the club head shown in FIG. 9A. In other words, the rotational moment is reduced as the radius of curvature Ry of the face roll is reduced and, therefore, the vertical gear effect can be reduced. Further, in case of off-center hits above the sweet spot, the face roll increases the launch angle δ. This is useful for preventing the flight height from lacking with decrease in the amount of backspin on off-center hits above the sweet spot. The face roll reduces the launch angle δ for off-center hits below the sweet spot and, therefore, it is also effective in preventing a hit ball from flying too high owing to increased amount of backspin.

Size increase of golf club heads has progressed rapidly with recent development of thin wall molding technology for metal materials. Large-sized golf club heads enable to have a large moment of inertia about a vertical axis passing through the center of gravity. For example, club heads having a moment of inertia of 4,000 $g \cdot cm^2$ or more are known. However, in case of club heads having a large moment of inertia about the vertical axis, the amount of rotation or twisting of the head "a" about the vertical axis is small for both the toe hit and the heel hit. Thus, the amount of sidespin imparted to the ball by the horizontal gear effect is also small. Therefore, as shown in FIG. 8C, club heads having, for example, a small face bulge radius Rx (i.e., a large curvature) and a large moment of inertia about the vertical axis cannot impart a sidespin in an amount commensurate with the deflection angle θ of the hit ball, in the toe hits or the heel hits, despite that the deflection angle θ becomes large. Since the hit ball does not curve back to the target flight direction "j" by such a reason, large-sized club heads have a problem of poor flight direction performance.

JP-A-2001-161866 discloses a golf club head having a horizontal bulge radius R1 of 480 to 765 mm and a vertical roll radius R2 larger than the radius R1. JP-A-8-089603 discloses a golf club head having a horizontal bulge radius R1 of at most 9 inches and a vertical roll radius R2 of at most 9 inches. In these prior art, the horizontal bulge radius and the vertical roll radius are not specified in association with the moment of inertia about the vertical axis of the head. Thus, these proposed golf club heads still have room for improvement.

It is an object of the present invention to provide a wood-type golf club head having an improved directional stability of hit ball and an increased flight distance.

This and other objects of the present invention will become apparent from the description hereinafter.

SUMMARY OF THE INVENTION

It has been found that the flight directionality and the flight distance of wood-type golf club heads can be improved when, with respect to club heads having a moment of inertia about the vertical axis passing through the club head's center of gravity as large as 4,000 to 5,900 $g \cdot cm^2$, the radius of curvature Rx of the face bulge is restricted to a specific range and the radius of curvature Ry of the face roll is determined in association with the bulge radius Rx.

In accordance with the present invention, there is provided a hollow wood-type golf club head having a face for hitting a golf ball, wherein:

the moment of inertia Ix about a vertical axis passing through the club head's center of gravity is 4,000 to 5,900 $g \cdot cm^2$ in the standard state that the club head is placed on a horizontal plane in the state that an axial center line of a shaft is disposed in an optional vertical plane and is inclined at a prescribed lie angle with respect to the horizontal plane and said face is inclined at a prescribed loft angle, said face has a face bulge and a face roll, the radius of curvature Rx of the face bulge is from 12 to 25 inches (about 30.48 to about 63.50 cm), and the Ry/Rx ratio of the radius of curvature Ry of the face roll to said radius of curvature Rx of the face bulge is 0.50 to 0.90.

It is preferable that the Rx/Ix ratio of the face bulge radius Rx to the moment of inertia Ix is from 0.0030 to 0.0045 $inch/g \cdot cm^2$.

It is also preferable that the Ry/Iy ratio of the face roll radius Ry to a moment of inertia Iy about a horizontal axis extending through the club head's center of gravity in the toe-heel direction is from 0.0030 to 0.0080 $inch/g \cdot cm^2$.

Further, it is preferable that the golf club head satisfies the following relationship:

$$1.0 \leqq (Ry/Rx)/(Iy/Ix) \leqq 2.0$$

wherein Rx is the radius of curvature of the face bulge (inch), Ry is the radius of curvature of the face roll (inch), Ix is the moment of inertia about the vertical axis ($g \cdot cm^2$), and Iy is the moment of inertia about the horizontal axis ($g \cdot cm^2$).

The wood-type golf club heads of the present invention have a large moment of inertia Ix about a vertical axis extending through the club head's center of gravity, i.e., 4,000 to 5,900 $g \cdot cm^2$, and a relatively large radius of curvature Rx of the face bulge, i.e., 12 to 25 inches. In case of golf club heads having such large moment of inertia and large face bulge radius, the twisting of the club heads is small for off-center hits on the toe or heel side, so occurrence of the horizontal gear effect is suppressed. However, since the golf club heads of the present invention have a face bulge having a large radius of curvature, the deflection angle of hit ball is small for the toe or heel side shots. Therefore, golf balls are struck out with a reduced amount of sidespin at a small deflection angle with respect to the target flight direction, and mildly curve back toward the target. Therefore, the golf club heads of the present invention have a stabilized flight directionality and an increased flight distance performance.

On the other hand, if the radius of curvature of the face bulge is large, the hitting face becomes easy to bend by impact of the ball since the face is flattened. Therefore, such a face has a possibility of imparting an excessively high spring effect (rebound property) to golf club heads, thus resulting in violation of golf rules. In contrast, in the club heads of the present invention, the radius of curvature Ry of the face roll is made smaller than the radius of curvature Rx of the face bulge so that the Ry/Rx ratio falls within the range of 0.50 to 0.90. The flexural rigidity of a face portion of the heads can be increased by a large curvature of the face roll. Therefore, the spring effect of the club heads can be prevented from excessively increasing without adopting any other means, for example, without increasing the wall thickness of the face portion.

DETAILED DESCRIPTION OF THE INVENTION

An embodiment of the present invention will be explained below with reference to the accompanying drawings.

Figure 1:
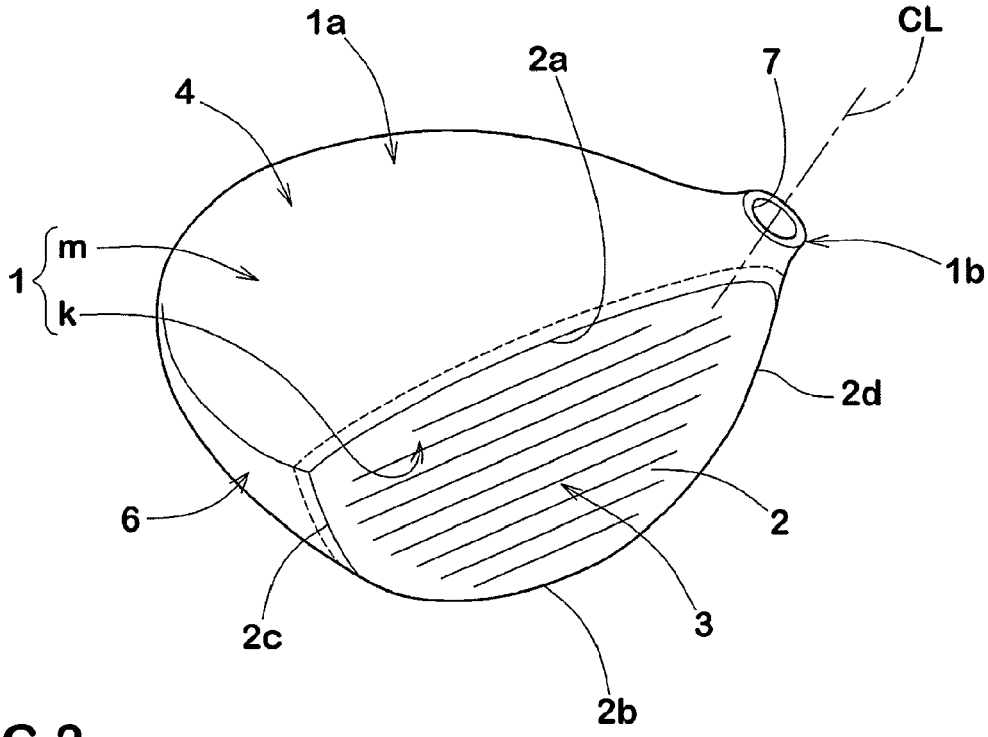
FIG. 1 is a perspective view of a golf club head showing an embodiment of the present invention.
Figure 2:
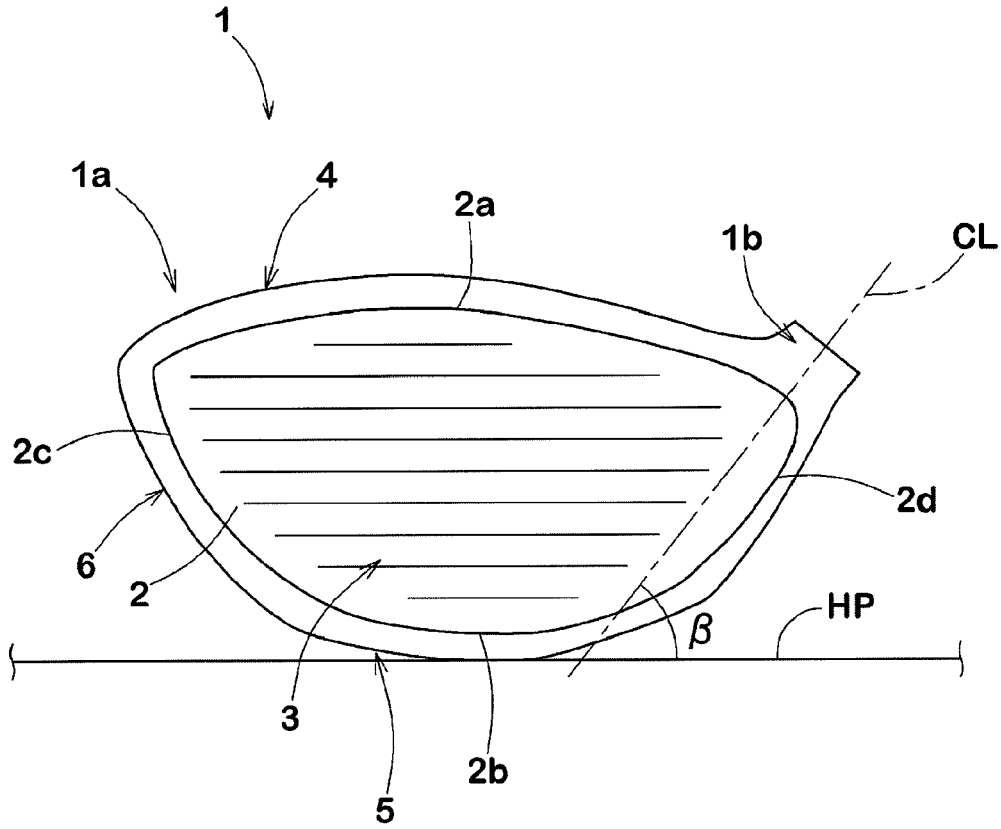
FIG. 2 is a front view of the club head of FIG. 1.
Figure 3:
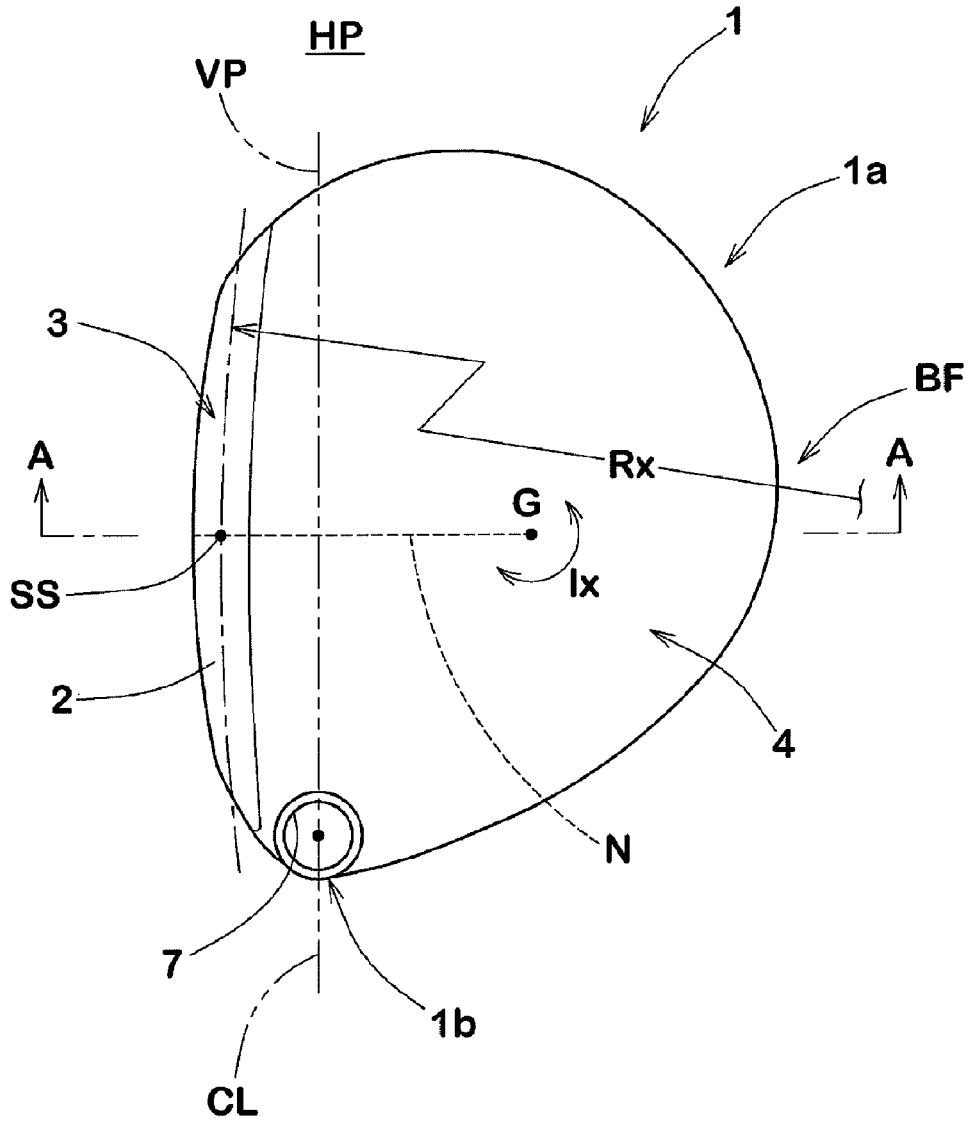
FIG. 3 is a plan view of the club head of FIG. 1.

FIGS. 1 to 4 are perspective, front and plan views of a wood-type golf club head 1 according to an embodiment of the present invention, and an enlarged cross sectional view along the line A-A of FIG. 3, respectively.

The wood-type golf club head 1 in this embodiment comprises a head body 1*a* having a hollow structure, and a hosel portion 1*b* which is disposed on a heel side of the body 1*a* for inserting a shaft.

The head body 1*a* includes a face portion 3 having a face 2 for hitting a golf ball on its front side, a crown portion 4 which extends from an upper edge 2*a* of the face 2 and forming the upper surface of the head 1, a sole portion 5 which extends from an lower edge 2*b* of the face 2 and forming the bottom surface of the head 1, and a side portion 6 which extends between the crown portion 4 and the sole portion 5 to connect them from a toe side edge 2*c* of the face 2 to a heel side edge 2*d* of the face 2 through a back face BF of the head 1. The head body 1*a* has a hollow portion "i".

The hosel portion 1*b* is disposed on a heel side of the crown portion 4 of the head body 1*a* and has a cylindrical shaft inserting hole 7 to attach a shaft (not shown). Since the axial center line of the shaft inserting hole 7 substantially agrees with the axial center line CL of the shaft when the shaft is inserted into the hole 7, it is used as the axial center line CL of the shaft when no shaft is attached to the club head 1.

Figure 4:
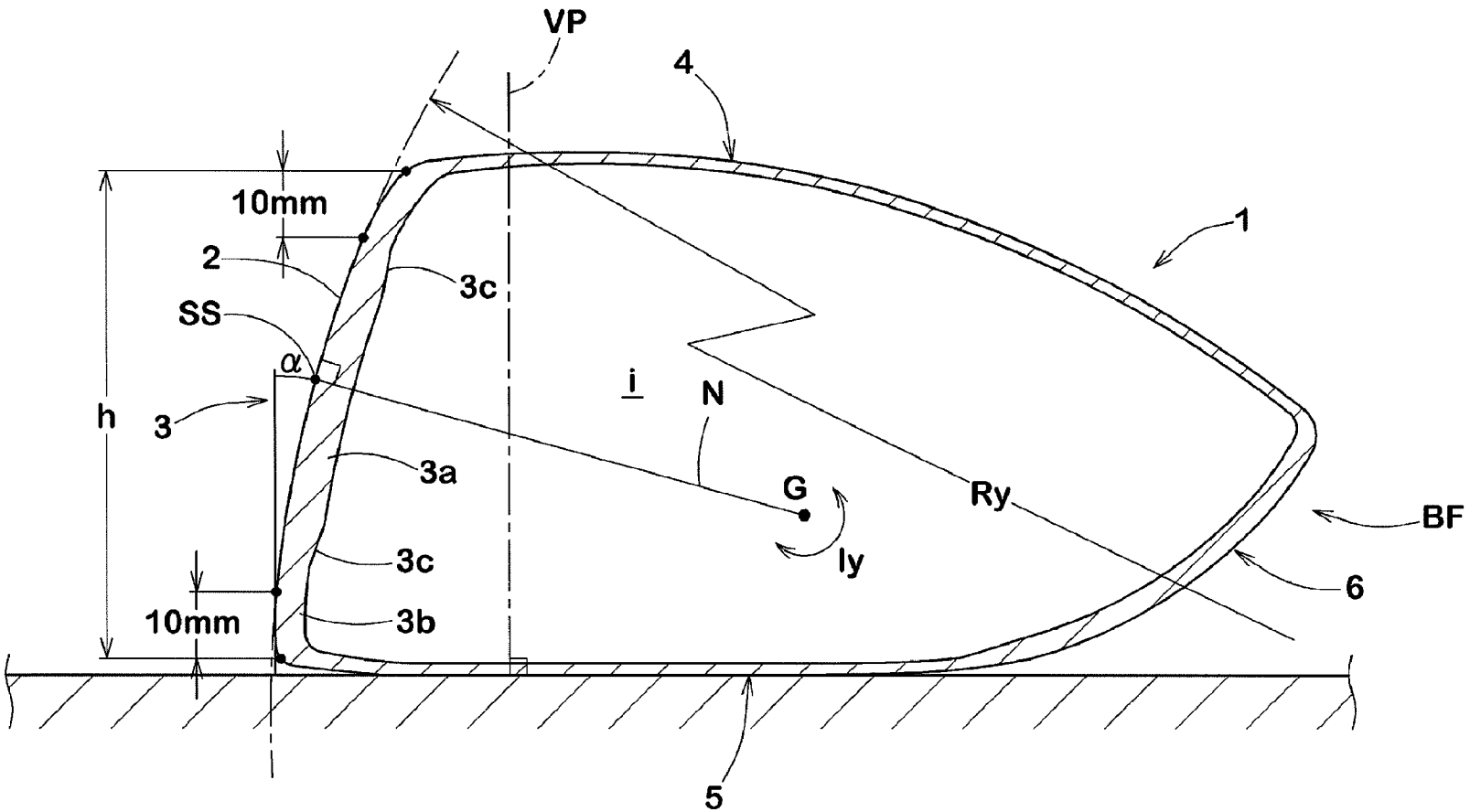
FIG. 4 is an enlarged cross sectional view along the line A-A of FIG. 3.

In FIGS. 1 to 4, the club head 1 is kept in the standard state. The term "standard state" of a golf club head as used herein denotes the state that, as shown in FIGS. 2 to 4, golf club head 1 is placed on a horizontal plane HP in the state that the axial center line CL of a shaft is disposed in an optional vertical plane VP and is inclined at a prescribed lie angle β with respect to the horizontal plane HP, and the hitting face 2 is inclined at a prescribed loft angle α (real loft angle, hereinafter the same) given to the head 1. The head 1 referred to herein is in the standard state unless otherwise noted. The terms "prescribed lie angle β" and "prescribed loft angle α" as used herein denote those previously given to the head 1.

Further, with respect to the club head 1, the up-down direction and the height direction denote those of the club head 1 in the standard state. The front-rear direction denotes, when the head 1 in the standard state is viewed from above, namely in a plane view of the head 1 (FIG. 3), a direction which is parallel to a perpendicular line N drawn from the club head's center of gravity G to the face 2, in other words, a direction parallel to a line N connecting the center of gravity G and a sweet spot SS. A face 2 side is the front and a back face BF side is the rear or back. The toe-heel direction of the club head 1 denotes a direction parallel to the vertical plane VP defined above, in other words, a direction perpendicular to the front-rear direction, in the plan view of the head 1 in the standard state (FIG. 3). The sweet spot SS is a point where a normal line N drawn to the face 2 from the center of gravity G of the head 1 intersects the face 2.

The term "wood-type golf club head" does not mean that the head is made of a woody material, but means golf club heads having a so-called wood-type head shape, e.g., driver (#1 wood), brassy (#2 wood), spoon (#3 wood), baffy (#4 wood) and cleek (#5 wood), and comprehends heads which are different from these heads in number or name, but have a shape approximately similar to these heads.

The club head 1 in this embodiment is produced from a metallic material. Preferable examples of the metallic material are, for instance, a stainless steel, a marageing steel, a pure titanium, a titanium alloy, an aluminum alloy, and combinations of these metals. For the purpose of weight reduction and so on, a nonmetallic material, e.g., fiber-reinforced resins and ionomers, may be used in a part of the club head 1. The club head 1 can be produced by joining a plurality of members or pieces (e.g., two to five pieces). The number of pieces is not particularly limited. Each member or piece is formed by various molding methods, e.g., casting, forging and pressing.

Preferably, the club head 1 of the present invention has a head volume of at least 400 $cm^3$, especially at least 420 $cm^3$, more especially at least 430 $cm^3$. The "head volume" denotes the volume of a portion surrounded by the outer surface of head 1 whose shaft inserting hole 7 in the hosel portion is filled up. Such a large head volume would provide a sense of ease to a player at the time of address, and it is also useful in improving the flight directionality since the moment of inertia or the depth of the center of gravity of the club head 1 can be increased. On the other hand, if the volume of the club head 1 is too large, problems may arise, e.g., increase of head weight, deterioration of swing balance, deterioration of durability and violation of golf rules. From such points of view, the volume of head 1 is preferably at most 470 $cm^3$, more preferably at most 460 $cm^3$.

In consideration of swing balance, rebound property, swing easiness or the like, it is preferable that the weight of club head 1 is at least 180 g, especially at least 183 g, more especially at least 185 g, and it is at most 220 g, especially at most 215 g, more especially at most 213 g.

The club head 1 of the present invention has a moment of inertia Ix of 4,000 to 5,900 $g \cdot cm^2$ about the vertical axis passing through the center of gravity G. The club head 1 having such a large moment of inertia Ix about the vertical axis can diminish the amount of rotation (twisting) of the head 1 about the vertical axis for toe or heel side off-center hits, whereby the amount of sidespin imparted to the ball by the horizontal gear effect is decreased to improve the straightness of flight. In order to more surely exhibit such an effect, the moment of inertia Ix about the vertical axis is preferably at least 4,100 $g \cdot cm^2$, more preferably at least 4,200 $g \cdot cm^2$. However, if the moment of inertia Ix is too large, it may violate golf rules which provide the upper limit of the moment of inertia Ix. Therefore, it is preferable that the moment of inertia Ix is at most 5,800 $g \cdot cm^2$. Such a large moment of inertia can be easily realized by increasing the head volume to fall within the above-mentioned range, by adjusting the thickness of respective portions of the head, and/or by additionally using a material having a high specific gravity, so as to distribute the weight to the perimeter of the club head.

Figure 5:
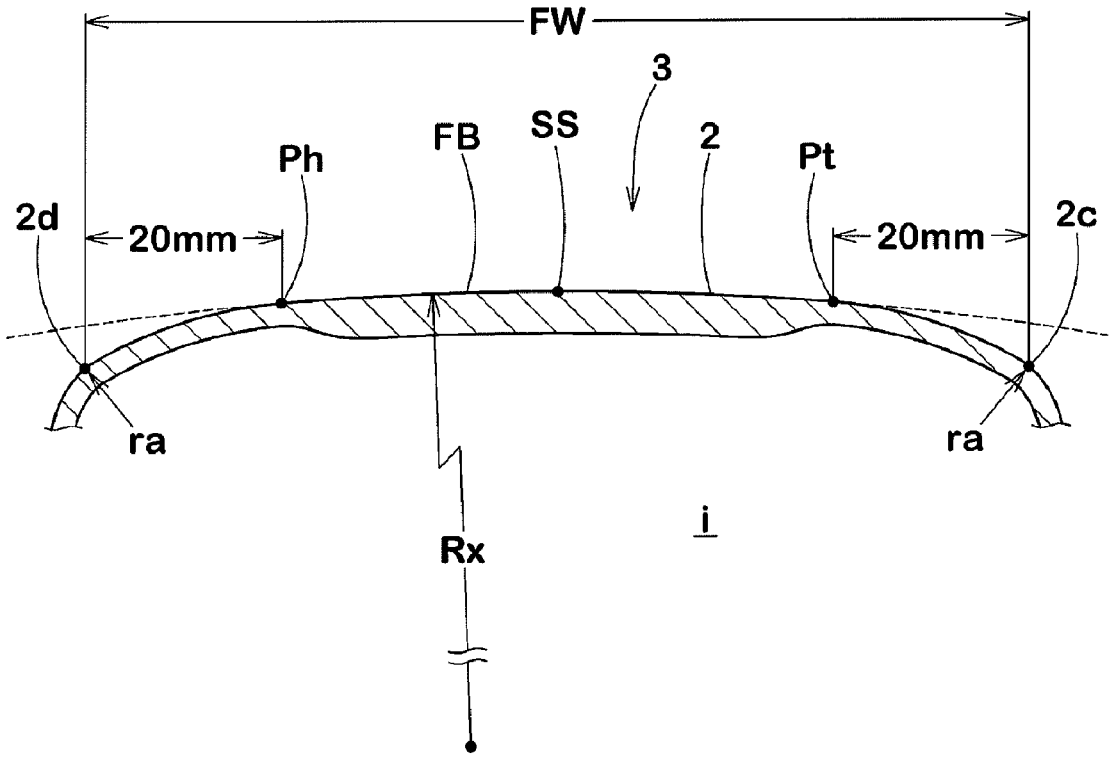
FIG. 5 is a horizontal cross sectional view of a face portion of the club head at a horizontal plane passing through the sweet spot.

FIG. 5 shows a horizontal cross section view passing through sweet spot SS of club head 1 in the standard state. As apparent from the drawing, the face 2 of the club head 1 in this embodiment is provided with a face bulge FB which is smoothly convex toward the front of the head 1 when the face is viewed from above. In this embodiment, the face bulge FB is provided to substantially the entire region of the face 2 in the toe-heel direction. The convex curvature of this face bulge FB is formed not only at the section position shown in FIG. 5, but also smoothly extends upward and downward.

Figure 8A:
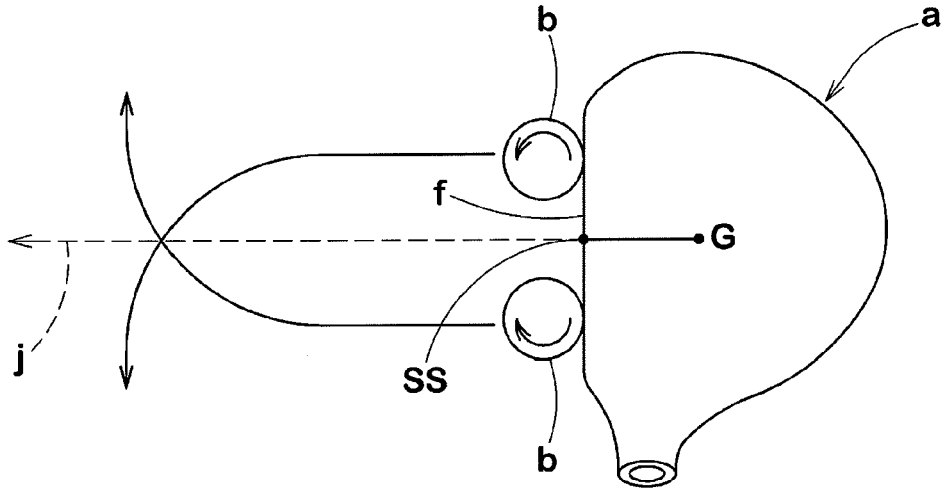
FIGS. 8A to 8C are schematic plan views for illustrating the horizontal gear effect.
Figure 8B:
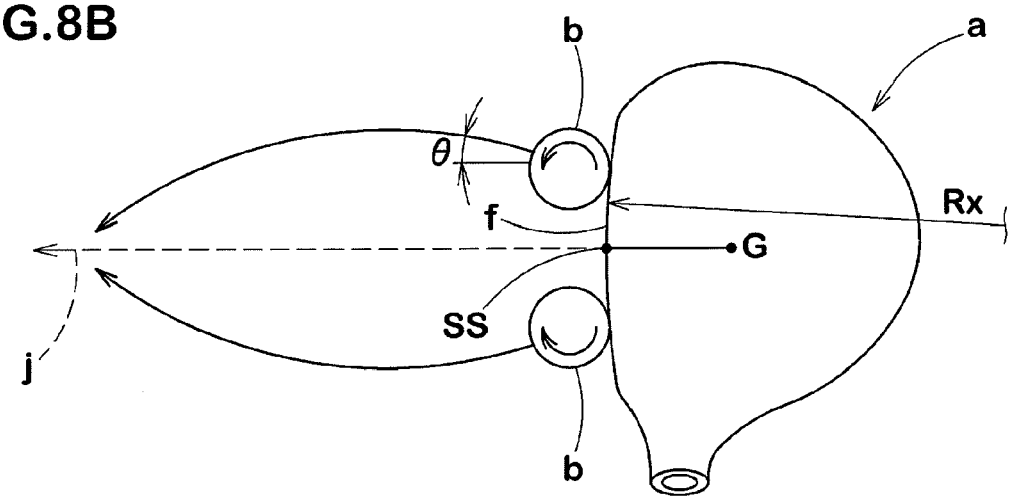
Figure 8C:
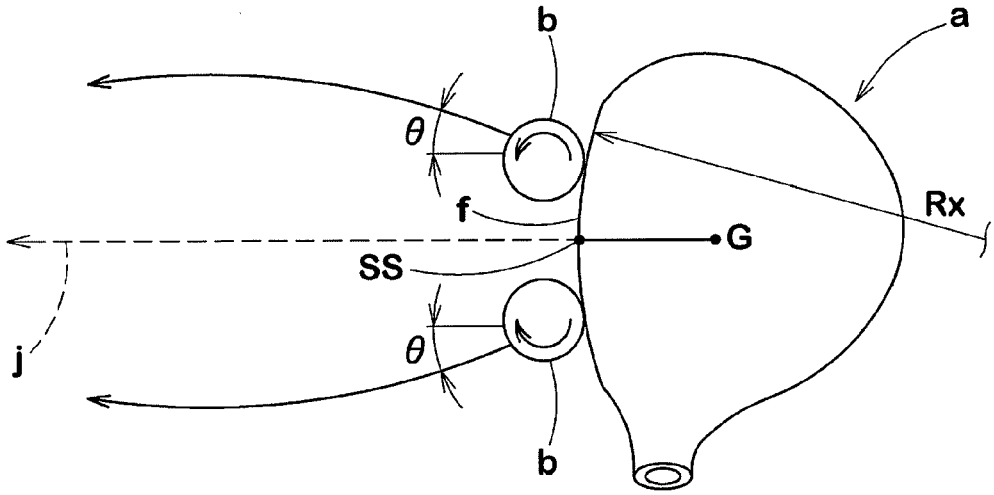

Since the club head 1 in this embodiment has a large moment of inertia Ix about the vertical axis of 4,000 $g \cdot cm^2$ or more as stated above, the horizontal gear effect is reduced and, therefore, the amount of sidespin is also reduced. If a face bulge BF having a small radius of curvature Rx is provided to such a head, a golf ball is struck out at an excessive deflection angle θ on toe or heel hits (cf. FIG. 8C), and does not curve back toward the intended line of flight due to a reduced sidespin. Thus, in the present invention, it is required that the radius of curvature Rx of the face bulge FB is 12 inches (about 30.48 cm) or more. Like this, with respect to golf club heads having a large moment of inertia Ix about the vertical axis, by selecting a large value as a radius of curvature Rx of the face bulge FB in association with the moment of inertia Ix, the horizontal deflection angle θ of the hit ball on toe or heel hits is reduced to improve the flight direction performance. The radius of curvature Rx of the face bulge FB is preferably at least 13 inches, more preferably at least 14 inches.

On the other hand, though the club heads 1 have a large moment of inertia Ix about the vertical axis, a slight horizontal gear effect still generates and it imparts a sidespin to the golf ball. Therefore, if the radius of curvature Rx of the face bulge FB is too large, the deflection angle θ on a mishit may become excessively small, so it cannot compensate for the gear effect spin and the flight directionality may be deteriorated. Therefore, from such a point of view, it is required that the radius of curvature Rx of the face bulge FB is at most 25 inches (about 63.50 cm). The radius of curvature Rx is preferably at most 24 inches, more preferably at most 22 inches.

Herein, as shown in FIG. 5, the "radius of curvature Rx of the face bulge FB" is defined, for convenience's sake, as a radius of a single arc which passes through the following three points; a face toe side point Pt on the face 2 which is apart from the toe side edge 2*c* of the face 2 toward the sweet spot SS by a distance of 20 mm in the toe-heel direction, a face heel side point Ph on the face 2 which is apart from the heel side edge 2*d* of the face 2 toward the sweet spot SS by a distance of 20 mm in the toe-heel direction, and the sweet spot SS. In the case that the face 2 has score lines or the like, the radius of curvature Rx is defined for the face in the state that the score lines or the like are filled. Further, in the case that the toe side edge 2*c* and the heel side edge 2*d* of the face 2 can be clearly identified by edge lines or the like, these edge positions are the edges 2*c* and 2*d*. However, in the case that the toe side edge 2*c* and the heel side edge 2*d* are not clearly determined, they are defined as positions at which the actual radius of curvature "ra" of the face 2 reaches 20 mm for the first time when the actual radius "ra" is measured from the sweet spot SS toward the toe and heel sides.

The larger the moment of inertia Ix about the vertical axis, the smaller the amount of rotation (twisting) of the club head 1 about a vertical axis passing through the club head's center of gravity G on mishit, so that the amount of sidespin imparted to the ball by the horizontal gear effect is reduced. Therefore, it is necessary to diminish the deflection angle θ of a ball struck out by toe or heel hits in accordance with the reduction of sidespin. From such a point of view, it is effective to determine the radius of curvature Rx of the face bulge FB in association with the moment of inertia Ix of the club head 1 about the vertical axis. Specifically, it is preferable that the ratio Rx/Ix of the radius of curvature Rx (inch) of the face bulge FB to the moment of inertia Ix ($g \cdot cm^2$) about the vertical axis is at least 0.0028, especially at least 0.0030, more especially at least 0.0031, further especially at least 0.0033, still further especially at least 0.0037, and is at most 0.0050, especially at most 0.0045, more especially at most 0.0040. When the radius of curvature Rx of the face bulge is determined in association with the moment of inertia Ix so that the Rx/Ix ratio ($inch/g \cdot cm^2$) falls within the above range, optimum combination of the amount of sidespin and the deflection angle θ of flight is realized, so the flight directionality and the flight distance can be further improved.

Figure 6:
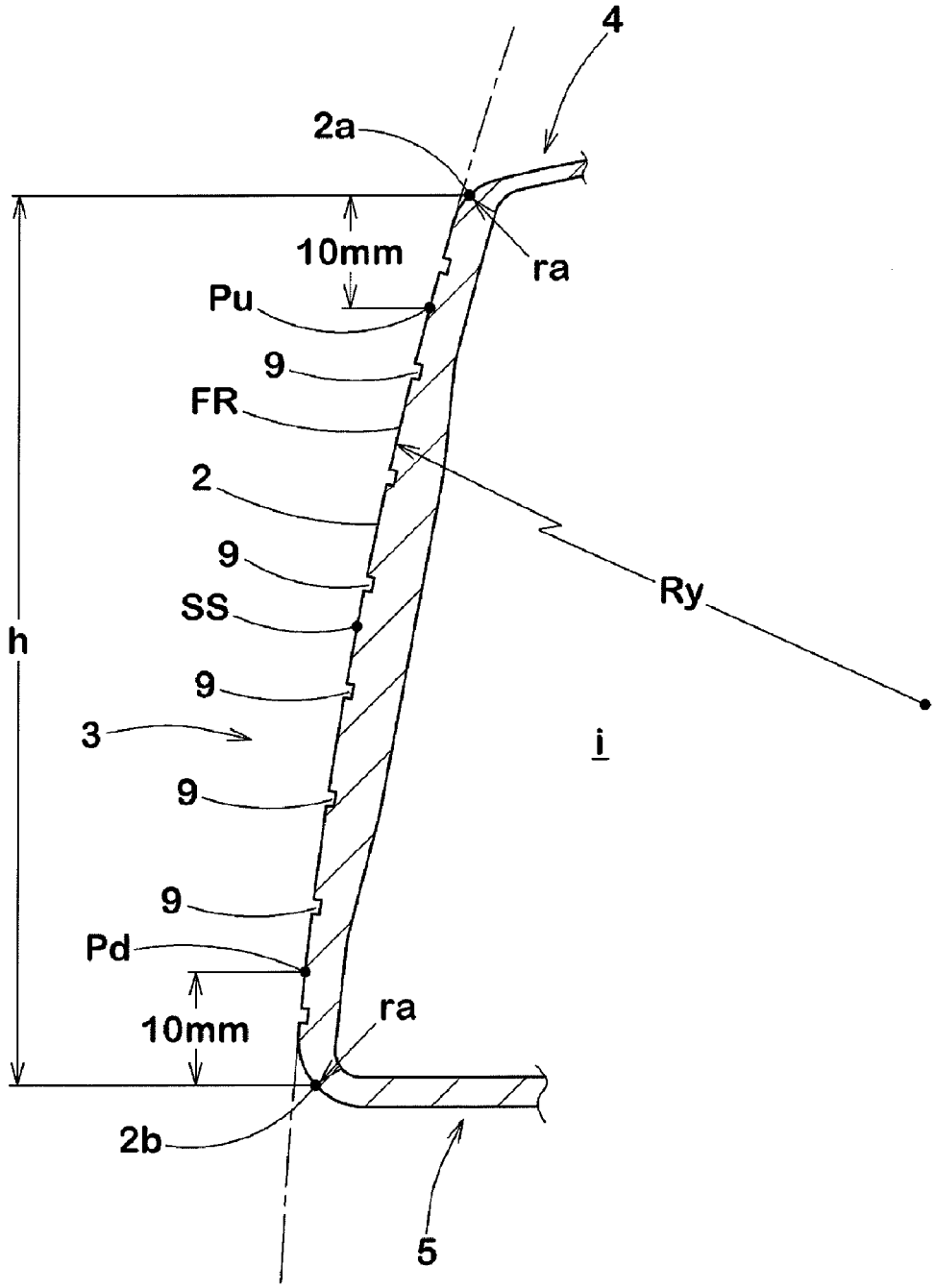
FIG. 6 is a partially enlarged view of FIG. 4.

FIG. 4 shows a vertical cross section view passing through the center of gravity G and the sweet spot SS of club head 1 in the standard state. FIG. 6 shows an enlarged partial view of the face portion 3 in FIG. 4. As apparent from these drawings, the face 2 of the club head 1 in this embodiment is provided with a face roll FR having a radius of curvature Ry which is smoothly convex toward the front of the head 1 when the face is viewed from the side. In this embodiment, the face roll FR is provided to substantially the entire region of the face 2 from top to bottom. The convex curvature of this face roll FR is formed not only at the section position shown in FIG. 6, but also smoothly extends toward both the toe and heel sides.

In the present invention, the radius of curvature Ry of the face roll FR is set to 0.50 to 0.90 times the radius of curvature Rx of the face bulge FB. In other words, the radius of curvature Ry of the face roll is selected so that the Ry/Rx ratio falls within the range of 0.50 to 0.90.

If the radius of curvature Rx of the face bulge FB is increased, the face portion 3 is more flattened, so the face becomes easy to bend by impact of a ball. Thus, a flattened face is likely to excessively enhance a spring effect (rebound property) of the club head, resulting in violation of golf rules. In the present invention, the flexural rigidity of the face portion 3 is enhanced without increasing the thickness or the like of the face portion 3 by setting the radius of curvature Ry of the face roll FR to a value smaller than the radius of curvature Rx of the face bulge FB, thereby preventing the spring effect from excessively appearing. The flexural rigidity of the face portion 3 can be enhanced by increasing the thickness of the face portion 3, but the increase of the thickness is undesirable since the degree of freedom in weight distribution design is remarkably lowered.

Figure 9A:
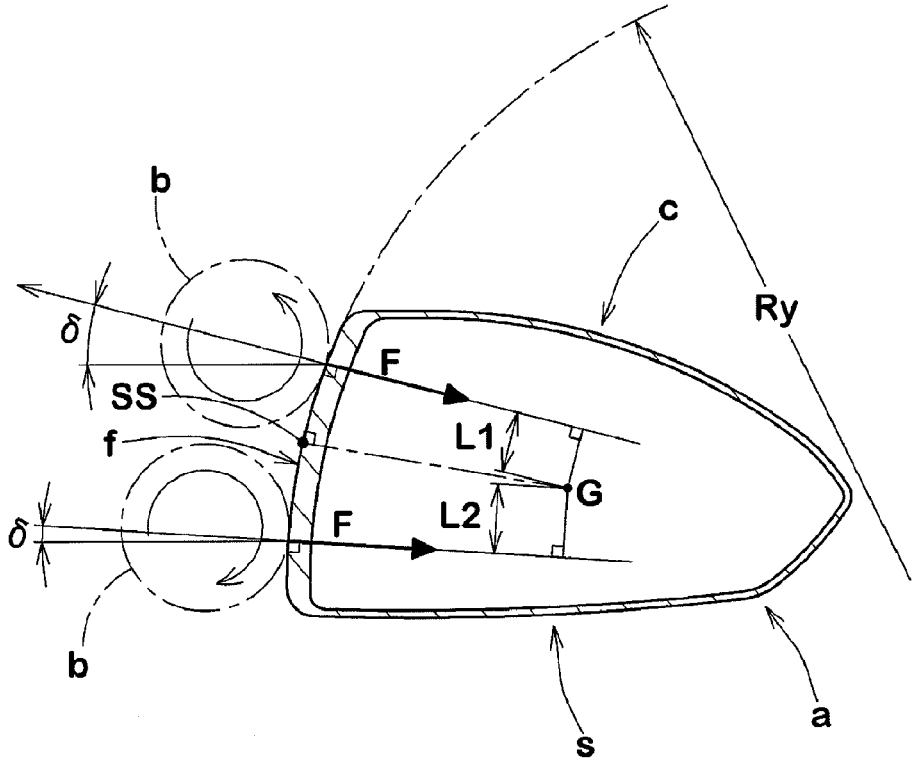
FIGS. 9A and 9B are cross sectional views for illustrating the vertical gear effect.
Figure 9B:
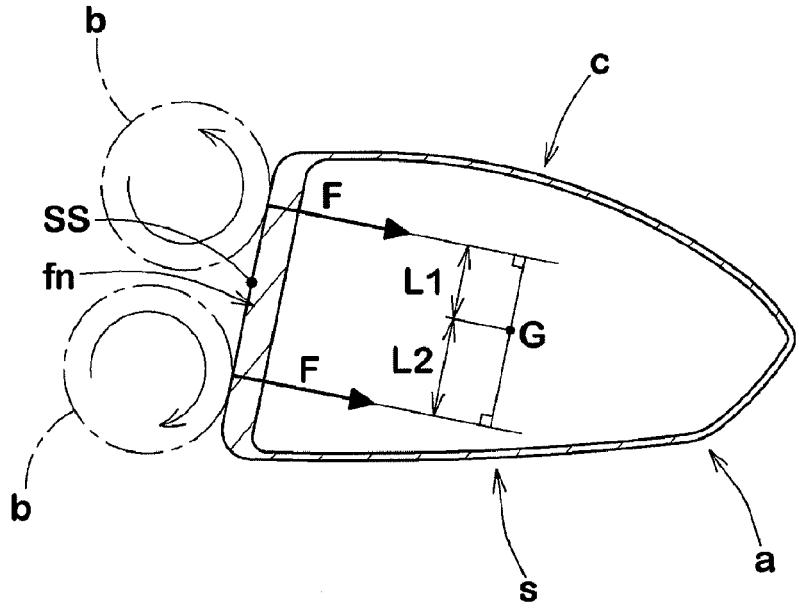

If the Ry/Rx ratio is less than 0.50, the radius of curvature Ry of the face roll FR is excessively small as compared with that of the face bulge FB and, therefore, the face looks like it is protruding forwardly at the time of address and the sense of use is remarkably deteriorated. Further, as shown in FIG. 9A, if the face is provided with a face roll, the launch angel δ on high or low hits is larger or smaller than the launch angle of a ball struck at sweet spot. When the radius of curvature Ry of the face roll FR is small, the difference in launch angle between the off-center hit and the center hit is noticeable and the flight distance tends to be unstable. From such points of view, the Ry/Rx ratio is preferably at least 0.55, more preferably at least 0.60.

On the other hand, if the Ry/Rx ratio is more than 0.90, the face roll FR is flattened, so an effect of enhancing the rigidity of the face portion 3 is not sufficiently obtained. As a result, the rebound property of the club head 1 tends to exceed an upper limit provided in golf rules, unless any measure such as thickening the face portion is taken. From such a point of view, the Ry/Rx ratio is preferably at most 0.85, more preferably at most 0.80.

Herein, as shown in FIG. 6, the "radius of curvature Ry of the face roll FR" is defined, for convenience's sake, as a radius of a single arc which passes through the following three points; a face upper side point Pu on the face 2 which is apart from the upper edge 2*a* of the face 2 toward the downside by a distance of 10 mm in the vertical direction, a face downside point Pd on the face 2 which is apart from the lower edge 2*b* of the face 2 toward the upper side by a distance of 10 mm in the vertical direction, and the sweet spot SS. In the case that the face 2 has score lines 9 or the like, the radius of curvature Ry is defined for the face in the state that the score lines 9 or the like are filled. Further, in the case that the upper edge 2*a* and the lower edge 2*b* of the face 2 can be clearly identified by edge lines or the like, these edge positions are the edges 2*a* and 2*b*. However, in the case that the upper edge 2*a* and the lower edge 2*b* are not clearly determined, they are defined as positions at which the actual radius of curvature "ra" of the face 2 reaches 20 mm for the first time, in the vertical cross section as shown in FIG. 6, when the actual radius "ra" is measured from the sweet spot SS toward the upper and down sides.

The radius of curvature Ry of the face roll FR is not particularly limited so long as it satisfies the above-mentioned Ry/Rx ratio condition. The change in launch angle δ on high and low hits tends to become large as the radius of curvature Ry decreases. Therefore, it is preferable that the radius of curvature Ry is at least 8 inches, especially at least 9 inches, more especially at least 10 inches. On the other hand, the vertical gear effect on high and low hits appears more strongly as the radius of curvature Ry increases, so the amount of backspin tends to be not stabilized to result in unstable flight distance. From such points of view, it is preferable that the radius of curvature Ry is at most 20 inches, especially at most 19 inches, more especially at most 17 inches.

In the club head 1 of the present invention, an excessive bending of the face portion 3 by impact of a ball is suppressed to control appearance of the spring effect within provisions of golf rules by adopting a small radius of curvature for the face roll FR. However, when the radius of curvature of the face roll is small, there is a tendency that the launch angle δ for high hits becomes large and the launch angle δ for low hits becomes noticeably small (cf. FIG. 9A). In particular, loss of flight distance is easy to occur at the time of low hits. In order to prevent such a lowering of the flight distance, it is preferable that the moment of inertia Iy about a horizontal axis extending through the center of gravity G in the toe-heel direction is set to a small value to deliberately increase the amount of rotation of the head about the horizontal axis for mishits. Thus, a relatively strong vertical gear effect appears for low hits to impart an increased amount of backspin to a ball, whereby even if the launch angle δ is low, a large lift force is imparted to the ball to minimally suppress the lowering of the flight distance.

In order to obtain such an action, it is preferable that the moment of inertia Iy about the horizontal axis is at most 5,900 $g \cdot cm^2$, especially at most 4,000 $g \cdot cm^2$, more especially at most 3,600 $g \cdot cm^2$. On the other hand, if the moment of inertia Iy about the horizontal axis is too small, the amount of rotation of the head about the horizontal axis becomes excessively large for mishits, so the flight distance tends to be not stabilized. Therefore, it is preferable that the moment of inertia Iy is at least 1,500 $g \cdot cm^2$, especially at least 1,800 $g \cdot cm^2$, more especially at least 2,000 $g \cdot cm^2$, further especially at least 3,000 $g \cdot cm^2$.

In particular, it is preferable that the Ry/Iy ratio ($inch/g \cdot cm^2$) of the radius of curvature Ry (inch) of the face roll to the moment of inertia Iy ($g \cdot cm^2$) about the horizontal axis is at least 0.0030, especially at least 0.0035, more especially at least 0.0040, and is at most 0.0080, especially at most 0.0070, more especially at most 0.0060.

Further, in order to stabilize the flight distance and the flight directionality, it is preferable that the Iy/Ix ratio of the moment of inertia Iy about the horizontal axis to the moment of inertia Ix of the vertical axis is at least 0.30, especially at least 0.35, more especially at least 0.40, and is at most 0.80, especially at most 0.75, more especially at most 0.70. If the Iy/Ix ratio is less than 0.30, the flight directionality is improved, but there is a tendency that the vertical gear effect appears strongly in excess for high and low hits, so the launch angle δ is not stabilized, thus resulting in unstable flight distance. On the other hand, if the Iy/Ix ratio is more than 0.80, the vertical gear effect on high and low hits is suppressed to stabilize the flight distance, but the flight directionality on toe and heel hits tends to deteriorate.

Further, as a result of inventor's investigation, it has been found that the flight distance and the flight directionality are further improved when the moment of inertia ratio Iy/Ix and the radius of curvature ratio Ry/Rx satisfy the following relationship:

$$1.0 \leqq (Ry/Rx)/(Iy/Ix) \leqq 2.0$$

If the ratio (Ry/Rx)/(Iy/Ix) is less than 1.0, the flight distance is easy to become unstable, and if it is more than 2.0, the flight directionality is easy to deteriorate.

While a preferable embodiment of the present invention has been described with reference to the drawings, it goes without saying that the present invention is not limited to only such an embodiment and various changes and modifications may be made.

The present invention is more specifically described and explained by means of the following examples. It is to be understood that the present invention is not limited to these examples.

EXAMPLES 1 TO 11 AND COMPARATIVE EXAMPLES 1 AND 2

Wood-type golf club heads having a base structure shown in FIGS. 1 to 4 were prepared according to the specifications shown in Table 1 and tested with respect to the flight distance and flight direction performances.

The respective club heads were prepared by welding a plate-like face member "k" and a hollow head body member "m", the boundary of which is shown in FIG. 1 by a chain line. Specifically, the head body member "m" was prepared by precision casting of a Ti-6Al-4V alloy. The face member "k" was prepared by subjecting an α-β titanium alloy (Titanium Alloy "SP700HM" made by JFE Steel Corporation having a composition of Al: 4.0 to 5.0% by weight, V: 2.5 to 3.5% by weight, Mo: 1.8 to 2.2% by weight, Fe: 1.7 to 2.3% by weight, and Ti and unavoidable impurities: the rest) to machine work and press work to have a thick center portion and a thin peripheral portion. The head body member "m" and the face member "k" were joined by laser welding to give club heads having the following common specifications.

Head weight: 200 g

Head volume: 460 $cm^3$

Real loft angle: 11°

Thickness of crown portion: 0.6 mm uniform thickness

Height "h" of face: suitably varied within the range of 40 to 65 mm (cf. FIG. 4)

Width FW of face: suitably varied within the range of 90 to 105 mm (cf. FIG. 5)

The wall thickness of the head body member was partially changed so that the thickness of the side portion falls within the range of 0.5 to 1.5 mm and the thickness of the sole portion falls within the range of 0.7 to 2.0 mm. Further, the face member was formed into a periphery-thin wall structure (cf. FIG. 4) having a center thick wall region 3*a* with a similar shape to the shape of the face 2 formed by the peripheral edges 2*a* to 2*d*, a peripheral thin wall region 3*b* and a transition portion 3*c* between them, in which the difference in thickness between the thick wall region and the thin wall region was 1.0 mm, and the entire thickness was adjusted so that the CT value according to the Pendulum Test Protocol (test rules of the R & A) falls within the range of 250±20. Thus, the center of gravity and the moment of inertia were adjusted.

The testing methods are as follows:

(1) Moment of Inertia

The moment of inertia was measured using Moment of Inertia Measuring Instrument Model No. 005-004 made by INERTIA DYNAMICS INC.

(2) Flight Distance and Flight Directionality

Same FRP shafts were attached to all club heads to be tested to give wood-type gold clubs having a full length of 45 inches. Each of ten right-hitting golfers having a handicap of 15 to 30 struck 10 golf balls with each club. There were measured the flight distance and the amount of swerve to the right or left of the stopping position of a struck ball with respect to the target flight direction, and the standard deviation values thereof were calculated. The amount of swerve was shown by a positive value for the both cases of swerving to the right and the left. Each of the results of measurement of the flight distance and the amount of swerve shown in Table 1 is the average of found values obtained by striking 100 balls (10 balls×10 golfers) for each club. The larger the value, the better the flight distance performance. The smaller the value, the better the direction performance.

Figure 7:
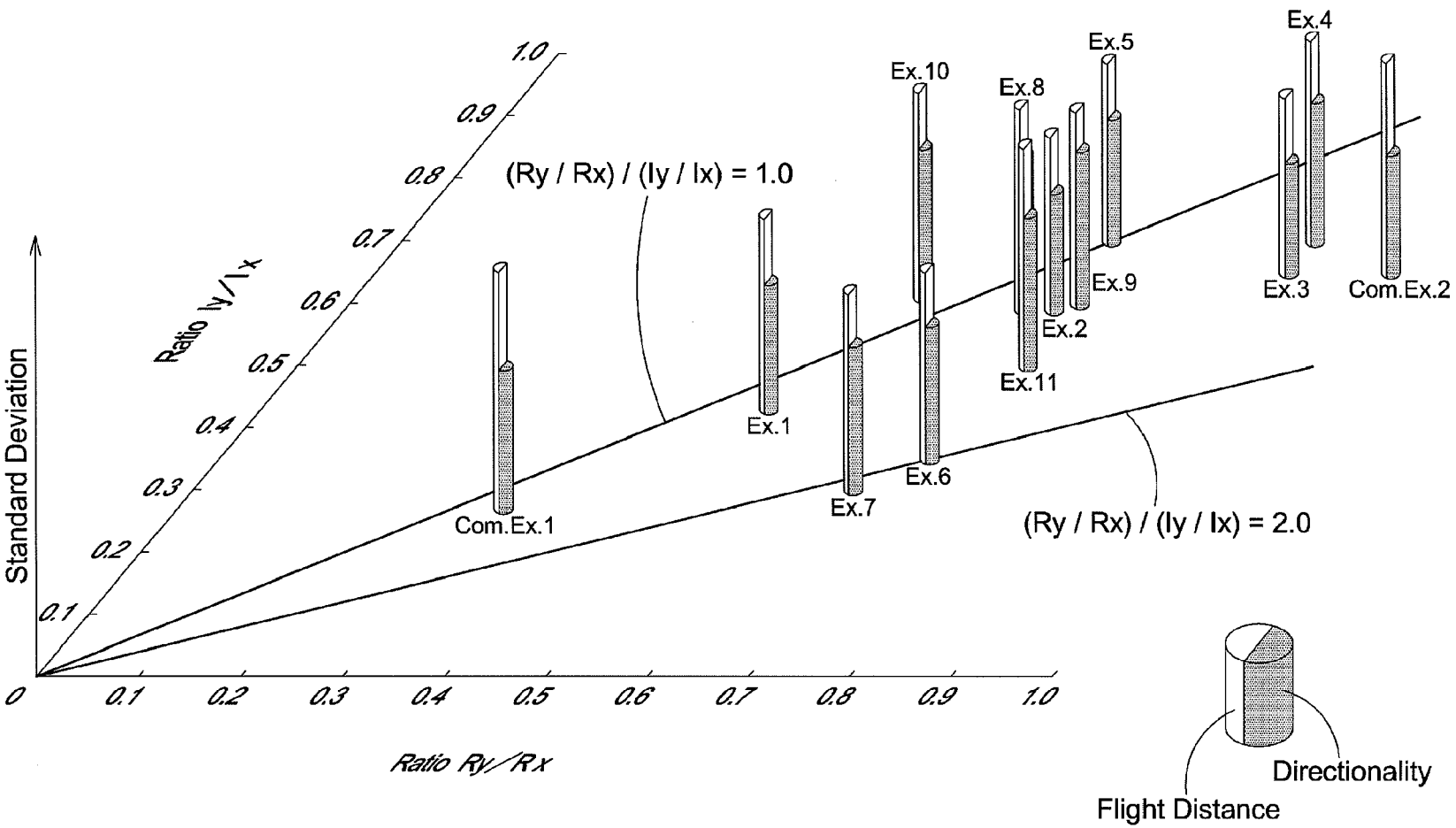
FIG. 7 is a graph showing a relationship between the Iy/Ix ratio and the Ry/Rx ratio.

The test results are shown in Table 1 and FIG. 7.

TABLE 1

| | Com. Ex. 1 | Ex. 1 | Ex. 2 | Ex. 3 | Com. Ex. 2 | Ex. 4 | Ex. 5 |
|---|---|---|---|---|---|---|---|
| Moment of inertia Ix about vertical axis (g · $cm^2$) | 5600 | 5400 | 5400 | 5400 | 5400 | 5000 | 5000 |
| Radius of curvature Rx of face bulge (inch) | 25 | 20 | 20 | 20 | 20 | 20 | 20 |
| Moment of inertia Iy about horizontal axis (g · $cm^2$) | 1500 | 2300 | 3200 | 3500 | 3500 | 4500 | 3500 |
| Radius of curvature Ry of face roll (inch) | 8 | 10 | 14 | 18 | 20 | 14 | 14 |
| Ry/Rx ratio | 0.32 | 0.50 | 0.70 | 0.90 | 1.00 | 0.70 | 0.70 |
| Rx/Ix ratio | 0.0045 | 0.0037 | 0.0037 | 0.0037 | 0.0037 | 0.0040 | 0.0040 |
| Ry/Iy ratio | 0.0053 | 0.0043 | 0.0044 | 0.0051 | 0.0057 | 0.0031 | 0.0040 |
| Iy/Ix ratio | 0.27 | 0.43 | 0.59 | 0.65 | 0.65 | 0.90 | 0.70 |
| (Ry/Rx)/(Iy/Ix) ratio | 1.2 | 1.2 | 1.2 | 1.4 | 1.5 | 0.8 | 1.0 |

TABLE 1-continued

| | | | | | | | |
|---|---|---|---|---|---|---|---|
| Thickness of center thick wall region of face portion (mm) | 3.3 | 3.3 | 3.4 | 3.5 | 3.7 | 3.4 | 3.4 |
| Flight distance (standard deviation A) (yard) | 23.7 | 19.1 | 17.3 | 17.6 | 21.1 | 20.2 | 17.9 |
| Flight directionality (standard deviation B of the amount of swerve) | 14.1 | 12.7 | 11.8 | 11.2 | 12.0 | 14.1 | 12.4 |
| (A + B)/2 | 37.8 | 31.8 | 29.1 | 28.8 | 33.1 | 34.3 | 30.3 |

| | Ex. 6 | Ex. 7 | Ex. 8 | Ex. 9 | Ex. 10 | Ex. 11 |
|---|---|---|---|---|---|---|
| Moment of inertia Ix about vertical axis ($g \cdot cm^2$) | 5000 | 5400 | 5400 | 5000 | 5900 | 4000 |
| Radius of curvature Rx of face bulge (inch) | 20 | 20 | 15 | 25 | 18 | 25 |
| Moment of inertia Iy about horizontal axis ($g \cdot cm^2$) | 1750 | 1600 | 3200 | 3000 | 3600 | 2000 |
| Radius of curvature Ry of face roll (inch) | 14 | 13 | 10 | 18 | 10 | 18 |
| Ry/Rx ratio | 0.70 | 0.65 | 0.67 | 0.72 | 0.56 | 0.72 |
| Rx/Ix ratio | 0.0040 | 0.0037 | 0.0028 | 0.0050 | 0.0031 | 0.0063 |
| Ry/Iy ratio | 0.0080 | 0.0081 | 0.0031 | 0.0060 | 0.0028 | 0.0090 |
| Iy/Ix ratio | 0.35 | 0.30 | 0.59 | 0.60 | 0.61 | 0.50 |
| (Ry/Rx)/(Iy/Ix) ratio | 2.0 | 2.2 | 1.1 | 1.2 | 0.9 | 1.4 |
| Thickness of center thick wall region of face portion (mm) | 3.4 | 3.4 | 3.2 | 3.6 | 3.3 | 3.6 |
| Flight distance (standard deviation A) (yard) | 18.8 | 19.7 | 20.1 | 19.2 | 20.5 | 21.7 |
| Flight directionality (standard deviation B of the amount of swerve) | 13.5 | 14.6 | 15.4 | 15.3 | 14.9 | 15.0 |
| (A + B)/2 | 32.3 | 34.3 | 35.5 | 34.5 | 35.4 | 36.7 |

From the results shown in Table 1, it is confirmed that the golf club heads of the Examples according to the present invention have stable flight distance and flight direction performances as compared with the club heads of the Comparative Examples.

What is claimed is:

1. A hollow wood-type golf club head having a face for hitting a golf ball, wherein:

the moment of inertia Ix about a vertical axis passing through the club head's center of gravity is 4,000 to 5,900 $g \cdot cm^2$ in the standard state that the club head is placed on a horizontal plane in the state that an axial center line of a shaft is disposed in an optional vertical plane and is inclined at a prescribed lie angle with respect to the horizontal plane and said face is inclined at a prescribed loft angle, the moment of inertia Iy about a horizontal axis extending through the club head's center of gravity is 3,000 to 5,900 $g \cdot cm^2$, said face has a face bulge and a face roll, the radius of curvature Rx of the face bulge is from 18 to 25 inches, the Ry/Rx ratio of the radius of curvature Ry of the face roll to said radius of curvature Rx of the face bulge is 0.50 to 0.90, and the Ry/Iy ratio of the face roll radius Ry to the moment of inertia Iy about the horizontal axis extending through the club head's center of gravity in the toe-heel direction is from 0.0040 to 0.0080 $inch/g \cdot cm^2$.

2. The wood-type golf club head of claim 1, wherein the Rx/Ix ratio of the face bulge radius Rx to the moment of inertia Ix is from 0.0028 to 0.0050 $inch/g \cdot cm^2$.

3. The wood-type golf club head of claim 1, wherein the Rx/Ix ratio of the face bulge radius Rx to the moment of inertia Ix is from 0.0031 to 0.0040 $inch/g \cdot cm^2$.

4. The wood-type golf club head of claim 1, which satisfies the following relationship:

$$1.0 \leqq (Ry/Rx)/(Iy/Ix) \leqq 2.0$$

wherein Rx is the radius of curvature of the face bulge (inch), Ry is the radius of curvature of the face roll (inch), Ix is the moment of inertia about the vertical axis ($g \cdot cm^2$), and Iy is the moment of inertia about the horizontal axis ($g \cdot cm^2$).

* * * * *